US006046144A

United States Patent [19]

Karol et al.

[11] Patent Number: 6,046,144

[45] **Date of Patent: *Apr. 4, 2000**

[54] COMBINATION OF PHOSPHATE BASED ADDITIVES AND SULFONATE SALTS FOR HYDRAULIC FLUIDS AND LUBRICATING COMPOSITIONS

[75] Inventors: Thomas J. Karol, Norwalk; Steven G. Donnelly, New Fairfield; Brian W. Stunkel, Stamford, all of Conn.

[73] Assignee: R.T. Vanderbilt Co., Inc., Norwalk, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/866,963

[22] Filed: Jun. 2, 1997

[51] Int. Cl.[7] ..... C10M 141/10

[52] U.S. Cl. ..... 508/279; 508/408; 508/438; 252/78.5

[58] Field of Search ..... 508/279, 408, 508/438; 252/78.5

[56] References Cited

U.S. PATENT DOCUMENTS

| | | | |
|---|---|---|---|
| 2,578,652 | 12/1951 | Cassaday | 260/461 |
| 2,763,614 | 9/1956 | Cantrell et al. | 508/408 |
| 2,971,912 | 2/1961 | Elliott et al. | 252/46.7 |
| 3,359,203 | 12/1967 | O'Halloran | 252/46.2 |
| 3,658,706 | 4/1972 | Meltsner | 252/49.8 |
| 3,791,976 | 2/1974 | Messina | 252/75 |
| 3,843,542 | 10/1974 | Adams | 252/75 |
| 3,876,550 | 4/1975 | Holubec | 252/47.5 |
| 3,923,669 | 12/1975 | Newingham et al. | 252/32.7 |
| 3,951,829 | 4/1976 | Mullen et al. | 508/408 |
| 4,130,494 | 12/1978 | Shaub | 252/32.5 |
| 4,225,450 | 9/1980 | Rosenberger | 252/47.5 |
| 4,371,447 | 2/1983 | Webb et al. . | |
| 4,383,931 | 5/1983 | Ryu et al. | 252/32.7 |
| 4,701,273 | 10/1987 | Brady et al. | 252/32.5 |
| 4,791,206 | 12/1988 | O'Neil et al. | 548/108 |
| 4,880,551 | 11/1989 | Doe | 252/47.5 |
| 5,308,521 | 5/1994 | Pavilon et al. | 252/49.6 |
| 5,362,419 | 11/1994 | Zinke et al. . | |
| 5,382,374 | 1/1995 | Takemitsu et al. | 252/73 |
| 5,580,482 | 12/1996 | Chasan et al. | 508/243 |

FOREIGN PATENT DOCUMENTS

| | | |
|---|---|---|
| 0821053 | 1/1998 | European Pat. Off. . |
| 1440129 | 10/1973 | United Kingdom . |
| 1518342 | 5/1975 | United Kingdom . |

OTHER PUBLICATIONS

English translation of claims of JPKokai No. 182,787/1990; Jul. 17, 1990.

*Primary Examiner*—Jerry D. Johnson
*Attorney, Agent, or Firm*—Baker Botts LLP

[57] ABSTRACT

Disclosed are synergistic antioxidant compositions composed of (1) amine salts of alkyl phosphates and (2) ethylenediamine, ammonium or metal salts of alkylarylsulfonates.

The antioxidant compositions are useful for formulating zinc-free antiwear hydraulic fluids and gear lubricating oils in conjunction with thiophosphate type antiwear agents, corrosion and rust inhibitors.

11 Claims, No Drawings

COMBINATION OF PHOSPHATE BASED ADDITIVES AND SULFONATE SALTS FOR HYDRAULIC FLUIDS AND LUBRICATING COMPOSITIONS

BACKGROUND OF THE INVENTION

The present invention concerns improved hydraulic fluids and lubricating compositions. More particularly, there are provided novel combinations of additives for imparting improved properties to hydraulic fluids and gear lubricating compositions.

Hydraulic fluids are designed to transmit force and motion in a variety of industrial machines. They are used in hydraulic systems where the fluid is under pressure and in contact with moving parts. Often these moving parts have fine tolerances, a variety of metallurgy and operate at high volume, efficiency and pressure. Particularly desired characteristics of hydraulic fluids are good resistance to oxidation, wear, rust and corrosion. Deterioration of a hydraulic fluid caused by inadequate oxidation inhibition will adversely affect the hydraulic oil and its ability to transmit power efficiently and to lubricate the hydraulic system.

Filterability of a hydraulic oil can also be adversely affected if an oil is contaminated with water. Poor filterability of a hydraulic oil in contact with water will prevent the hydraulic system from transmitting force to the hydraulic motors.

The hydraulic oil must also have the ability to separate from water. Although small amounts of water can be tolerated, large amounts of water can attribute to rust, oxidation, decreased ability to lubricate and erratic pump action.

Because of the multifunctional nature of hydraulic oils, a commercially acceptable hydraulic fluid composition must meet established industry standards for all critical characteristics.

Particularly useful are antiwear hydraulic oils which possess wear characteristics and many of the performance characteristics of lubricating oils. In the past, antiwear hydraulic oils were formulated with zinc compounds, such as dithiophosphates and the like.

In addition to zinc compounds, antiwear hydraulic oils contain a complement of other additives necessary to prevent wear and deterioration of the equipment while the oil transmits the required power and motion. Lubricating compositions using zinc based antiwear additives contain other functional additives necessary to perform the lubricating function for a particular use. Thus, prior art teaches two different zinc based compositions specifically designed either for application as hydraulic fluids or for application as lubricants.

U.S. Pat. No. 4,383,931 teaches lubricating compositions containing the combination of sulfurized oil and methylenebis(dihydrocarbyldithiocarbamate) in conjunction with zinc dihydrocarbyldithiophosphate.

U.S. Pat. No. 3,876,550 discloses similar multifunctional combinations based on methylenebis (dihydrocarbyldithiocarbamate) in conjunction with a rust inhibitor of the succinic acid type. U.S. Pat. No. 3,359,203 teaches the use of adducts of dihydrocarbyldithiophosphoric acid and aliphatic esters of maleic or fumaric acid in conjunction with phenol type antioxidants.

U.S. Pat. No. 4,880,551 discloses a lubricating composition containing an antioxidant synergist consisting of 1-[di (4-octylphenyl)aminomethyl] tolutriazole, methylenebis(di-n-butyldithiocarbamate), and a phenolic antioxidant U.S. Pat. No. 4,130,494 teaches that the load carrying capacity of synthetic lubricants is improved by adding a combination of organoamine salt of phosphate ester and organosulfonic acid ammonium salt.

U.S. Pat. No. 4,225,450 discloses lubricants that are stabilized with hydroxy-benzyl dithiocarbamates in conjunction with other lubricating antioxidants such as aromatic amines, sterically hindered phenols, esters of thiodipropionic acid, salts of dithiophosphoric acid, corrosion inhibitors such as benzotriazole, organic amines, amine salts of phosphoric acid partial esters, dinonylnaphthalenesulfonate salts and others.

None of the above referenced lubricating compositions possess the hydraulic function.

U.S. Pat. No. 3,658,706 discloses antioxidants for lubricating and functional fluids consisting of phosphorothionates and dihydrocarbylthioalkanoates.

Hydraulic oils contain metal corrosion inhibitors and rust inhibitors. U.S. Pat. No. 2,971,912 discloses benzotriazole type metal corrosion inhibitors. It is known to add sulfonate type rust inhibitors to zinc containing hydraulic oils as disclosed in U.S. Pat. No. 3,843,542, U.S. Pat. No. 3,923,669 and U.S. Pat. No. 3,791,976.

Environmental concerns linked to the toxicity of the heavy metal zinc has rendered zinc containing hydraulic oils undesirable. Disadvantageously, currently available antiwear hydraulic oils containing no or very low amounts of zinc have limited commercial use. These so called ashless antiwear hydraulic oils cannot satisfy all test standards; that is, they do not possess the varied and balanced properties required of antiwear hydraulic oils.

Surprisingly, it has been discovered that a synergistic combination of certain phosphates and sulfonates together with other functional additives impart to hydraulic oils the necessary balanced standard properties which allow the oil to perform the desired hydraulic functions even in the absence of zinc.

SUMMARY OF THE INVENTION

In accordance with the invention, there are provided synergistic antioxidant compositions for base oils composed of (1) amine salts of alkyl phosphates wherein the amine is selected from ammonia, primary and secondary alkylamines and (2) ethylenediamine, ammonium or metal salts of petroleum or aromatic sulfonate wherein the metal is selected from alkali or alkaline earth metals and the aromatic substituent is selected from alkylated benzenes and alkylated naphthalenes having 1 to 4 alkyl groups of 8 to 20 carbons each and wherein the amount of phosphate to sulfonate are present in critical ratios of about 14:1 to about 1:2.75.

An object of the invention is lubricating compositions comprising a major amount of base oil and an oxidation inhibiting amount of the above defined synergistic antioxidant composition.

Another object of the invention is hydraulic oil compositions comprising (a) a major amount of base oil;

(b) an oxidation inhibiting amount of a synergistic antioxidant composition consisting of (1) amine salts of alkyl phosphate wherein the amine is selected from ammonia, primary and secondary alkylamines and (2) ethylenediamine, ammonium or metal salts of petroleum or aromatic sulfonate wherein the metal is selected from alkali or alkaline earth metals and the aromatic substituent is selected from alkylated benzenes and alkylated naphthalenes having 1 to 4 alkyl groups of 8 to 20 carbons each and wherein the phosphate and sulfonate are present in critical ratios;

(c) a wear inhibiting amount of thiophosphate esters selected from the group consisting of (i) dialkyldithiophosphate succinates of the structural formula

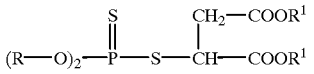

wherein R and $R^1$ are independently selected from alkyl groups having 3 to 8 carbon atoms, (ii) dithiophosphoric acid esters of carboxylic acid of the formula

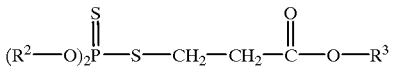

wherein $R^2$ is alkyl having 3 to 8 carbon atoms and $R^3$ is alkyl having 2 to 8 carbon atoms, and (iii) triphenylphosphorothionates of the formula

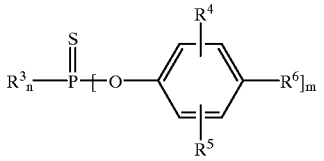

wherein n=1–2, m=2–3, $R^3$ is alkyl having 1 to 20 carbon atoms, $R^4$ and $R^5$ are hydrogen or alkyl groups;

(d) methylenebis(dialkyldithiocarbamate) wherein the alkyl group contains 4 to 8 carbon atoms;

(e) a metal deactivating amount of compositions selected from the group of (i) triazole compounds selected from 1-(phenylaminomethyl) tolutriazole and 1-(phenylaminomethyl) benzotriazole wherein the phenyl group may have one to three substituent groups selected from alkyl or arylalkyl groups and mixtures thereof, (ii) a composition consisting of benzotriazole and diphenylamine wherein the diphenylamine is substituted by one to three alkyl or arylalkyl groups or mixtures thereof and wherein the benzotriazole to diphenylamine is present in the molar ratio of 1:1, and (iii) a composition consisting of tolutriazole and diphenylamine wherein the diphenylamine is substituted by one to three alkyl or arylalkyl groups or mixtures thereof and wherein the tolutriazole to diphenylamine is present in the molar ratio of 1:1;

(f) a hindered phenolic antioxidant selected from the group consisting of alkylated phenols having at least two alkyl substituents each having from 1 to 4 carbon atoms; and optionally (g) alkyl acid phosphate, alkyl aryl sulfonic acid or mixtures thereof.

DETAILED DESCRIPTION OF THE INVENTION

The stabilized compositions of the invention are composed of known commercially available ingredients which act synergistically as antioxidants and together with other functional additives produce the desired characteristics in antiwear hydraulic oils and gear lubricating oils.

The synergistic amine salts of alkyl phosphates are prepared by known methods, e.g. a method disclosed in U.S. Pat. No. 4,130,494. A suitable mono-or diester of phosphoric acid or their mixtures is neutralized with an amine. When mono-ester is used, two moles of the amine will be required, while the diester will require one mole of the amine. In any case, the amount of amine required can be controlled by monitoring the neutral point of the reaction where the total acid number is essentially equal to the total base number. Alternately, a neutralizing agent such as ammonia or ethylenediamine can be added to the reaction.

The preferred phosphate esters are aliphatic esters, among others, 2-ethylhexyl, n-octyl, and hexyl mono-or diesters. The amines can be selected from primary or secondary amines. Particularly preferred are tert-alkyl amines having 10 to 24 carbon atoms. These amines are commercially available as for example Primene® 81R manufactured by Rohm and Haas Co.

The synergistic sulfonic acid salts are well known in the art and are available commercially. Representative of the aromatic sulfonic acids that can be used in preparing the synergists of the invention are alkylated benzenesulfonic acids and alkylated naphthalenesulfonic acids having 1 to 4 alkyl groups of 8 to 20 carbons each. Particularly preferred are naphthalenesulfonates substituted by alkyl groups having 9 to 18 carbons each, as for example dinonylnaphthalenesulfonate.

The sulfonates are used in the form of neutralized salts of ammonia, ethylenediamine, alkali metal or alkaline earth metals. Particularly preferred are salts of basic calcium and basic lithium. The basic salts are in the form of metal hydroxide molecule associated with the acid.

The synergistic composition acts as antioxidant and reduces the tendency of the base oil to deteriorate and produce products of oxidation such as sludge and deposits on metal parts. Thus, the ability of the oil to lubricate and protect the integrity of the hydraulic system is not compromised.

The synergistic antiwear composition is particularly compatible with ashless antiwear agents of the dithiophosphate ester type. One class of compounds are adducts of O,O-dialkyl-phosphorodithioates and esters of maleic or fumaric acid. The compounds can be prepared by known methods as described in U.S. Pat. No. 3,359,203, as for example O,O-di(2-ethylhexyl) S-(1,2-dicarbobutoxyethyl) phosphorodithioate.

Another class of compounds useful to the invention are dithiophosphoric acid esters of carboxylic acid esters. Preferred are alkyl esters having 2 to 8 carbon atoms, as for example 3-[[bis(1-methylethoxy)phosphinothioyl]thio] propionic acid ethyl ester. A third class of ashless dithiophosphates of the invention are triphenylphosphorothionates wherein the phenyl group may be substituted by up to two alkyl groups. An example of this group, among others, is triphenyl-phosphorothionate available commercially as IRGALUBE®TPPT (manufactured by Ciba-Geigy).

Methylenebis(dialkyldithiocarbamate) compounds are commercially available. For example, methylenebis (dibutyldithiocarbamate) is manufactured under the trade name VANLUBE® 7723 by R. T. Vanderbilt Company, Inc.

The antioxidant and metal deactivating functions of the hydraulic oil are further improved by the additives 1-[di(4-octylphenyl)aminomethyl] tolutriazole and a hindered phenolic compound, both described in U.S. Pat. No. 4,880,551.

The hindered phenols can be selected from 2,6-alkyl substituted phenols and may carry up to four alkyl groups. Particularly preferred are 2,6-di-t-butylphenol, 2,6-di-t-butyl-4-sec-butylphenol, 2,6-di-t-butyl-4-methylphenol and butylated phenol mixtures.

Surprisingly, the filterability of the oil can be improved by adding to the oil composition alkyl acid phosphate and aromatic sulfonic acid or mixtures thereof. The alkyl acid phosphate may be di- and mono-alkyl acid phosphate or mixtures thereof. The alkyl groups may be straight or branched and contain 6 to 12 carbon atoms. The aromatic sulfonic acids can be selected from alkylated arylsulfonic acids. Particularly preferred are benzenesulfonic acids and naphthalenesulfonic acids substituted by 1 to 4 alkyl groups having 8 to 20 carbon atoms each.

The oil compositions may contain known corrosion inhibitors, rust inhibitors and metal deactivators depending on the specific application and equipment used. For example, corrosion inhibitors such as tolutriazole and 2-alkyl-1H-imidazole-1-ethanol where the alkyl group contains 7–17 carbon atoms are suitable additives for hydraulic fluids.

The base oil of the hydraulic fluid can be selected from base oil stock of petroleum oils and mineral oils. Premium mineral oils of high viscosity are particularly suited for antiwear hydraulic fluids for use in most hydraulic systems.

The base oil of gear lubricating oils can be base oil stock of mineral oil or petroleum oil of lubricating viscosity as for example cycloparaffinic and paraffinic stock oils. The lubricating oils can be also formulated from synthetic bases as for example organic esters, polyglycols and olefin oligomers. The lubricating oil compositions may contain viscosity index improvers and dispersants.

The amount of the synergistic combination required to impart the performance characteristics necessary to hydraulic oils may range from about 0.01 to 5 percent of the weight of the total oil formulation. The preferred range is about 0.05 to 0.20 percent based on the weight of the total oil formulation. Although the individual components of the synergistic combination are known in the art, the additives must, however, be added in relatively high amounts. Surprisingly, it has been found that by adding relatively low amounts of the synergistic combination satisfies the industrial standards of antiwear hydraulic oils. This fact points toward enhanced functional activity due to compatible interaction of the synergistic combination with other components of the final hydraulic oil formulation. Lubricating compositions may contain about 0.1 to 10 percent of the synergistic composition depending on the intended use of the lubricant.

The following examples are given for the purpose of further illustrating the invention. All percentages and parts are based on weight unless otherwise indicated.

EXAMPLE 1

Compositions of the invention were prepared by adding to the base oil calcium di-$C_{10-18}$-alkylbenzenesulfonate and $C_{12-14}$-alklyl primary amine isooctyl acid phosphate antioxidant synergists. A total of 0.15 percent of the synergistic composition was added by varying the ratios of the sulfonate and phosphate synergists, as indicated in Table I. Test sample 1 contained only the phosphate and sample 11 contained only the sulfonate.

The primary amine used for neutralization of the phosphate was a commercial product, Primene® 81-R manufactured by Rohm and Haas Co.

The base oil was Sunvis®21 manufactured by Sun Oil Co. In addition to the synergistic antioxidants, the base oil contained 0.80 percent of a mixture containing equal parts of methylenebis(dibutyldithiocarbamate), 1-(di(4-octylphenyl) aminomethyl)-tolutriazole, and commercial mixed butylated phenols, Hitec® 4733 manufactured by Ethyl Corp. and 1,2-dicarbobutoxyethyl-0,0-di-n-propylphosphorodithioate.

The compositions were tested by the ASTM D2272 method. The test was conducted with 50 gram samples at 150° C. and initial oxygen pressure of 620 kPa (90 psi). A "pass" oil has a high induction time. The results were compiled in Table I.

Synergistic compositions of the invention, samples 3 through 9, show improvement as compared to samples containing only one of the components which failed the test. The optimum antioxidant function is shown in samples 6, 7 and 8.

TABLE I

| | Rotating Bomb Oxidation Test | | | | | | | | | | |
|---|---|---|---|---|---|---|---|---|---|---|---|
| | Percent in Sample | | | | | | | | | | |
| Antioxidant Ingredient | 1 | 2 | 3 | 4 | 5 | 6 | 7 | 8 | 9 | 10 | 11 |
| Calcium di-$C_{10-18}$-alkylbenzenesulfonate (50% active) | — | 0.02 | 0.04 | 0.06 | 0.03 | 0.10 | 0.14 | 0.18 | 0.22 | 0.26 | 0.30 |
| $C_{12-14}$-amine isooctyl phosphate (50% active) | 0.30 | 0.28 | 0.26 | 0.24 | 0.22 | 0.20 | 0.16 | 0.12 | 0.08 | 0.04 | — |
| Functional Properties Average Induction Time, Min. | 415 | 505 | 615 | 690 | 710 | 767 | 710 | 725 | 545 | 390 | 340 |

EXAMPLE 2

Package compositions of additives for antiwear hydraulic oil were prepared by blending the additives in the amounts given in Table II. The compositions include the antioxidant synergists calcium di-$C_{10-18}$-alkylbenzenesulfonate and $C_{12-14}$-alkyl primary amine isooctyl acid phosphate wherein the amine is a commercial product, Primene 81-R. About one percent of the package compositions were added to the base oil, SUNVIS 21.

The compositions were subjected to the tests required for establishing the standard specifications for industrially acceptable antiwear hydraulic oil.

The oil compositions 14, 15 and 16 containing the synergistic antioxidant composition contained other functional additives in critical amounts.

The oil compositions of the invention, samples 14 and 15, had balanced properties that satisfied all of the varied requirements of antiwear hydraulic oils.

The samples 12 and 13 containing only one of the antioxidants, did not pass all the tests.

The results are compiled in Table II. The tests are described hereinbelow.

The Rotating Bomb Oxidation Test, ASTM D-2272 was performed as described in Example 1.

The Four-Ball Wear Test was conducted according to the method described is ASTM D4172. Four highly polished steel balls 12.7 mm in diameter were placed in the tester and about 10 ml test sample was placed in the ball pot, sufficient to cover the balls. The test was conducted at a rotation speed of 1800 rpm under a load of 20 kg for 1 hour at 54.4° C. The scar diameter was measured to the nearest 0.01 mm.

Thermal stability was evaluated by a modified ASTM D2070 test for determining the thermal stability of hydraulic oils. The test is known as the Cincinnati Milacron method. Copper and steel rods in contact pith the oil were evaluated for appearance and weight loss after 168 hours at 135° C. Sludge was determined by filtering oil though No. 41 Whatman pad and 8 micron pad and weighing the residue. The total weight was calculated by adding the weight of the filtrates to that of sludge removed from copper rods. Viscosity change was determined by the ASTM D-445 method and the neutralization number by the ASTM D-974 method. Test samples 14 and 15 of the invention passed all of the above criteria as given by the Cincinnati Milacron standard.

The Rust Inhibition Test was conducted by the ASTM D-665 method using the A and B procedures. The test was conducted for 24 hours at 60° C.

The ASTM D-943 oxidation test was conducted until test oil reached a total acid number of 2 mg. KOH/g of oil at 95° C.

The ASTM D-4310 sludge test was conducted for 1000 hours at 95° C.

TABLE II

Antiwear Hydraulic Oil

| Components | Percent in Sample 12 | 13 | 14 | 15 |
|---|---|---|---|---|
| 1,2-Dicarbobutoxyethyl 0,0-di-n-propyl-phosphorodithioate | 0.2 | 0.2 | 0.2 | — |
| 1,2-Dicarbobutoxyethyl 0,0-di(2-ethyl-hexyl)phosphorodithioate | — | — | — | 0.2 |
| Methylenebis(dibutyldithiocarbamate) | 0.2 | 0.2 | 0.2 | 0.2 |
| 1-(Di(4-octylphenyl)amino-methyl)tolutriazole (50%) | 0.2 | 0.2 | 0.2 | 0.2 |
| Butylated phenols (50%) | 0.2 | 0.2 | 0.2 | 0.2 |
| Calcium dialkylbenzenesulfonate (50%) | 0.2 | — | 0.1 | 0.1 |
| Amine isooctyl acid phosphate | — | 0.2 | 0.1 | 0.1 |
| Base oil | 99.0 | 99.0 | 99.0 | 99.0 |
| Functional Properties | | | | |
| 4-Ball wear at 20 kg, scar diameter, mm | 0.31 | 0.29 | 0.27 | 0.26 |
| Thermal Stability | Fail | Fail | Pass | Pass |
| ASTM D-2272 Induction Time, minutes | 662 | 338 | 730 | 600 |
| ASTM D-665 Rust Test A/B | P/P | P/P | P/P | P/P |
| ASTM D-943 Oxidation, hours | 1700 | 4042 | 3210 | 2716 |
| ASTM D-4310 Sludge, mg | 200.2 | 8.6 | 16.8 | 20.8 |

EXAMPLE 3

Gear oil compositions were prepared by adding the synergistic antioxidant composition of the invention. The synergists were calcium di-$C_{10-18}$-alkylbenzenesulfonate and $C_{12-14}$-alkyl primary amine isooctyl acid phosphate. The base oil was formulated with other functional additives required to impart to the gear oil the required standard properties.

In addition, didodecylbenzene sulfonic acid and octyl acid phosphate were added to improve the filterability of the gear oil composition. The base oil used was NS oil manufactured by Shell Oil Company.

The test results are compiled in Table III.

The tests ASTM D 665B and the thermal stability test was conducted by the methods described in Example 2.

Filterability of the samples was determined with apparatus consisting of 300 ml glass Millipore filter funnel with ground glass seal and stainless steel membrane support to hold Millipore 1.2 micron pore size; 47 mm filter diameter membrane. Test samples were prepared by mixing 300 ml test sample with 0.35 g of distilled water. Filterability was determined by measuring the time required to filter 300 ml test sample.

Hydraulic stability was determined by the ASTM D2619 method. A 75 g sample, 25 g water and copper test specimen were sealed in a pressure type bottle. The bottle was rotated end for end for 48 hours in an oven at 93° C. The weight change of copper and the acidity of the water layer were determined and compiled in Table III.

The Four Square Gear Oil Tester measures the wear protection characteristics of a gear lubricating oil. The test gears are weighed and secured on test shafts. The gear case is then charged with 1600 ml oil. The test is run for 15 minutes at 1500 rpm at 90° C.

The gear assembly is disassembled, weighed and reassembled for subsequent testing. The test procedure is repeated through 12 load stages of testing or until 10 mg of weight loss is recorded between two successive load stages. A material passing through at least 10 stages affords good antiwear properties for lubricating oils, as measured by this bench test.

The above embodiments have shown various aspects of the present invention. Other variations will be evident to those skilled in the art. Such modifications are intended to be within the scope of the invention as defined by the appended claims.

TABLE III

Hydraulic Oil Tests

| Components | Percent in Sample 16 | 17 |
|---|---|---|
| 1,2-Dicarbobutoxyethyl 0,0-di-n-propylphosphoro-dithioate | 0.20 | 0.20 |
| Methylenebis(dibutyldithiocarbamate) | 0.20 | 0.20 |
| 1-(Di(4-octylphenyl)aminomethyl)tolutriazole (50%) | 0.20 | 0.20 |
| Butylated phenols | 0.20 | 0.20 |
| Amine isooctyl acid phosphate | 0.10 | 0.08 |
| Calcium dialkylbenzenesulfonate (50%) | 0.10 | 0.08 |
| Didodecylbenzenesulfonic acid | — | 0.02 |
| Isooctyl acid phosphate | — | 0.02 |
| Base oil | 99.0 | 99.0 |
| Functional Properties | | |
| Rust, ASTM D665B | Pass | Pass |
| Thermal Stability | Pass | — |
| Hydraulic Stability, ASTM D2619 | Pass | Pass |
| Cu weight loss, mg/cm$^2$ | 0.01 | 0 |
| Water/acid, mg KOH/g | 1.0 | 2 |
| Filterability Time for 300 ml, min. | | |
| Dry | 6 | 6 |
| Wet | — | 23 |
| Four Square Gear Oil Tester, Pass stage | 10 | 11 |

We claim:

1. A synergistic antioxidant composition for petroleum and mineral base oils consisting of (1) amine salts of alkyl phosphate wherein the amine is selected from ammonia, primary and secondary alkylamines or mixtures thereof and (2) ammonium, ethylenediamine or metal salts of petroleum or aromatic sulfonate wherein the metal is selected from alkali or alkaline earth metals and the aromatic substituent is selected from alkylated benzenes and alkylated naphthalenes having 1 to 4 alkyl groups of 8 to 20 carbons each, and wherein phosphate to sulfonate is present in the ratio of about 14:1 to about 1:2.75.

2. A hydraulic oil composition comprising (a) major amount of base oil;

(b) an oxidation inhibiting amount of a synergistic composition consisting of (1) amine salts of alkyl phosphate wherein the amine is selected from ammonia, primary and secondary alkylamines and (2) ethylenediamine, ammonium or metal salts of petroleum or aromatic sulfonate wherein the metal is selected from alkali or alkaline earth metals and the aromatic substituent is selected from alkylated benzenes or alkylated naphthalenes having 1 to 4 alkyl groups of 8 to 20 carbons each and wherein the ratio of phosphate to sulfonate is about 14:1 to 1:2.75.

(c) a wear inhibiting amount of thiophosphate esters selected from the group consisting of (i) dialkyldithiophosphate succinates of the structural formula

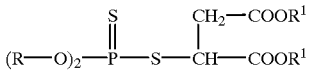

wherein R and $R^1$ are independently selected from alkyl groups having 3 to 8 carbon atoms, (ii) dithiophosphoric acid esters of carboxylic acid of the formula

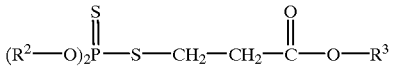

wherein $R^2$ is alkyl having 3 to 8 carbon atoms and $R^3$ is alkyl having 2 to 8 carbon atoms, and (iii) triphenylphosphorothionates of the formula

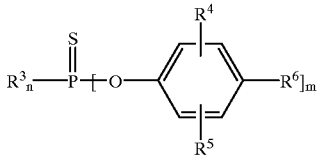

wherein n=1–2, m=2–3, $R^3$ is alkyl having 1 to 20 carbon atoms, $R^4$ and $R^5$ are hydrogen or alkyl groups;

(d) methylenebis(dialkyldithiocarbamate) wherein the alkyl group contains 4 to 8 carbon atoms;

(e) a metal deactivating amount of compositions selected from the group of (i) triazole compounds selected from 1-(phenylaminomethyl) tolutriazole and 1-(phenylaminomethyl) benzotriazole wherein the phenyl group may have one to three substituent groups selected from alkyl or arylalkyl groups and mixtures thereof, (ii) a composition consisting of benzotriazole and diphenylamine wherein the diphenylamine is substituted by one to three alkyl or arylalkyl groups or mixtures thereof and wherein the benzotriazole to diphenylamine is present in the molar ratio of 1:1, and (iii) a composition consisting of tolutriazole and diphenylamine wherein the diphenylamine is substituted by one to three alkyl or arylalkyl groups or mixtures thereof and wherein the tolutriazole to diphenylamine is present in the molar ratio of 1:1; and (f) a hindered phenolic antioxidant selected from the group consisting of alkylated phenols having at least two alkyl substituents each having from 1 to 4 carbon atoms.

3. A composition according to claim 2 which further contains 0.02 to 1.0 percent of an organic acid selected from alkyl acid phosphate and alkylarylsulfonic acid wherein the aryl group is benzene or naphthalene.

4. A composition according to claim 2 which contains corrosion inhibiting amount of tolutriazole and 2-alkyl-1H-imidazole-1-ethanol.

5. A composition according to claim 2 wherein the total amount of additives (a) to (f) are present in the amount of 1.0 to 5.0 percent.

6. Zinc-free antiwear hydraulic oil composition consisting of major amount of base oil and minor amounts of functional additives (a) 1,2-Dicarbobutoxyethyl 0,0-di-(2-ethylhexyl) phosphorodithioate;

(b) Methylenebis(dibutyldithiocarbamate);

(c) 1-(Di(4-octylphenyl)aminomethyl)tolutriazole;

(d) Butylated phenols;

(e) Calcium dialkylbenzenesulfonate;

(f) $C_{12-14}$-alkylamine isooctyl acid phosphate;

(g) a metal deactivating amount of compositions selected from the group of (i) triazole compounds selected from 1-(phenylaminomethyl) tolutriazole and 1-(phenylaminomethyl) benzotriazole wherein the phenyl group may have one to three substituent groups selected from alkyl or arylalkyl groups and mixtures thereof, (ii) a composition consisting of benzotriazole and diphenylamine wherein the diphenylamine is substituted by one to three alkyl or arylalkyl groups or mixtures thereof and wherein the benzotriazole to diphenylamine is present in the molar ratio of 1:1, and (iii) a composition consisting of tolutriazole and diphenylamine wherein the diphenylamine is substituted by one to three alkyl or arylalkyl groups or mixtures thereof and wherein the tolutriazole to diphenylamine is present in the molar ratio of 1:1; and (h) 2-Alkyl-1H-imidazole-1-ethanol.

7. Zinc-free antiwear hydraulic oil composition consisting of major amount of base oil and minor amounts of functional additives (a) 1,2-Dicarbobutoxyethyl 0,0-di-n-propylphosphorodithioate;

(b) Methylenebis (dibutyldithiocarbamate);

(c) 1-(Di(4-octylphenyl)aminomethyl)tolutriazole;

(d) Butylated phenols;

(e) Calcium dialkylbenzenesulfonate; and (f) $C_{12-14}$-alkylamine isooctyl acid phosphate.

8. A composition according to claim 7 which contains optional corrosion inhibitors selected from 2-alkyl-1H imidazole-1-ethanol wherein the alkyl group contains 7–17 carbon atoms.

9. A gear lubricating oil composition comprising a major amount of petroleum and mineral base oils of lubricating viscosity and 0.01 to 1.0 percent of a synergistic antioxidant composition consisting of (1) amine salts of alkyl phosphate wherein the amine is selected from ammonia, primary and secondary alkylamines or mixtures thereof and (2) ammonium, ethylenediamine or metal salts of petroleum or aromatic sulfonate wherein the metal is selected from alkali or alkaline earth metals and the aromatic substituent is selected from alkylated benzenes and alkylated naphthalenes having 1 to 4 alkyl groups of 8 to 20 carbons each, and wherein phosphate to sulfonate is present in the ratio of about 14:1 to 1:2.75.

10. An antioxidant composition for base oils consisting of $C_{12-14}$-alkylamine isooctyl acid phosphate and calcium di-$C_{10-18}$-alkylbenzene sulfonate and wherein phosphate to sulfonate is present in the ratio of about 14:1 to about 1:2.75.

11. A lubricating oil composition having improved filterability comprising a major amount of base oil of lubricating viscosity and 0.01 to 1.0 percent of a synergistic antioxidant composition consisting of (1) amine salts of alkyl phosphate wherein the amine is selected from ammonia, primary and secondary alkylamines or mixtures thereof and (2) ammonium, ethylenediamine or metal salts of petroleum or aromatic sulfonate wherein the metal is selected from alkali or alkaline earth metals and the aromatic substituent is selected from alkylated benzenes and alkylated naphthalenes having 1 to 4 alkyl groups of 8 to 20 carbons each, and wherein phosphate to sulfonate is present in the ratio of about 14:1 to 1:2.75, and containing organic acids selected from alkyl acid phosphate and alkylarylsulfonic acid wherein the aryl group is benzene or naphthalene.

* * * * *